US005339595A

United States Patent [19]

Rouse et al.

[11] Patent Number: 5,339,595

[45] Date of Patent: Aug. 23, 1994

[54] HEAD FOR APPARATUS FOR FILLING A CONTAINER AND PLACING A STOPPER THEREIN

[75] Inventors: Daniel H. Rouse, Greenville; Thomas D. McClure, Rocky Mount; Ralph E. Reese, Patterson, all of N.C.

[73] Assignee: Abbott Laboratories, Abbott Park, Ill.

[21] Appl. No.: 999,037

[22] Filed: Dec. 31, 1992

[51] Int. Cl.[5] ..... B65B 39/02; B65B 39/04

[52] U.S. Cl. ..... 53/88; 53/320; 53/489; 53/510

[58] Field of Search ..... 53/287, 432, 510, 405, 53/403, 320, 319, 489, 88, 86, 79

[56] References Cited

U.S. PATENT DOCUMENTS

| | | | |
|---|---|---|---|
| 2,319,234 | 5/1943 | Hothersall | 53/489 X |
| 2,625,312 | 1/1953 | Kantor | 53/88 |
| 2,714,980 | 8/1955 | Schlayer et al. | 53/319 X |
| 2,795,246 | 6/1957 | Kuebler | 53/79 X |
| 3,169,355 | 2/1965 | Hollaway et al. | 53/88 |
| 4,995,222 | 2/1991 | Whitman et al. | 53/510 |

*Primary Examiner*—James F. Coan

*Attorney, Agent, or Firm*—A. Nicholas Trausch

[57] ABSTRACT

An improved head is provided for an apparatus which places a stopper in the opening of a filled container. The head has a sleeve which includes an inflatable bladder for receiving the end of the filled container and for temporarily sealing the periphery of the container around the opening. A housing is disposed over the sleeve. The housing has a top surface and defines an access passage which communicates between the top surface and the inside of the sleeve. The stopper is subsequently inserted into the container through the access passage. The housing defines a chamber around the access passage, and the chamber communicates with the access passage. A conduit projects from the housing top surface in communication with the chamber, and vacuum can be drawn through the conduit.

9 Claims, 3 Drawing Sheets

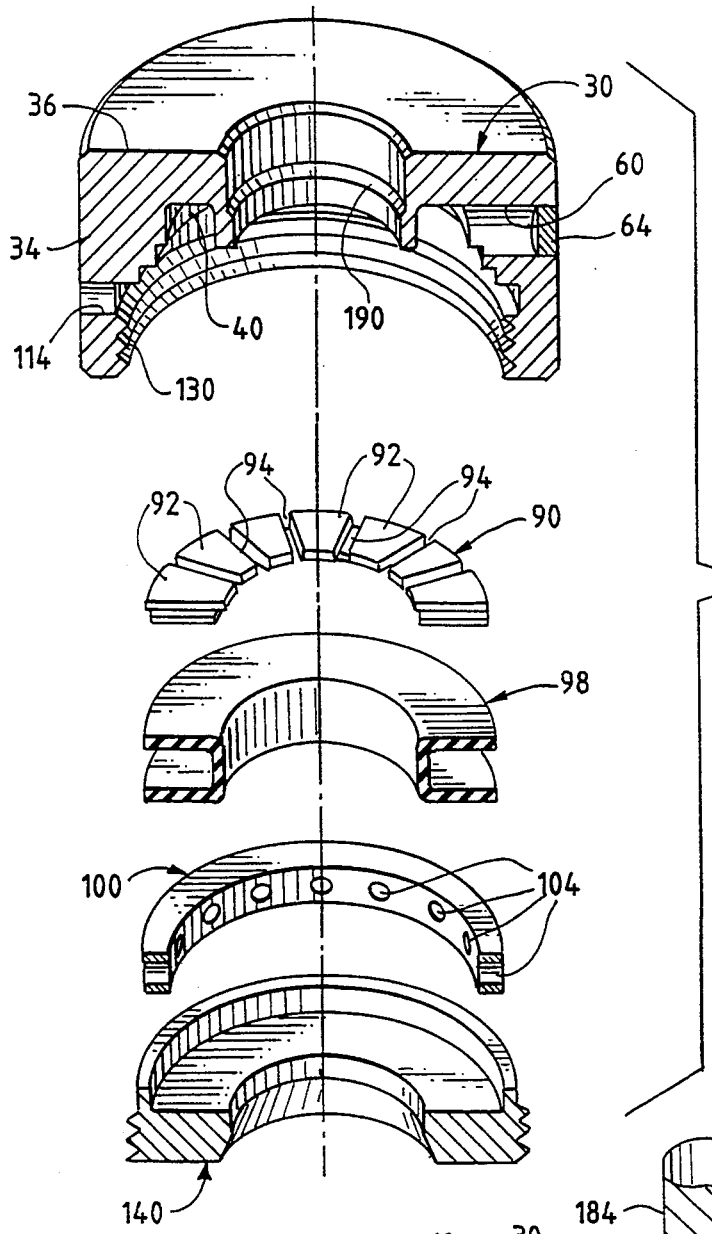
Fig. 5
Fig. 6
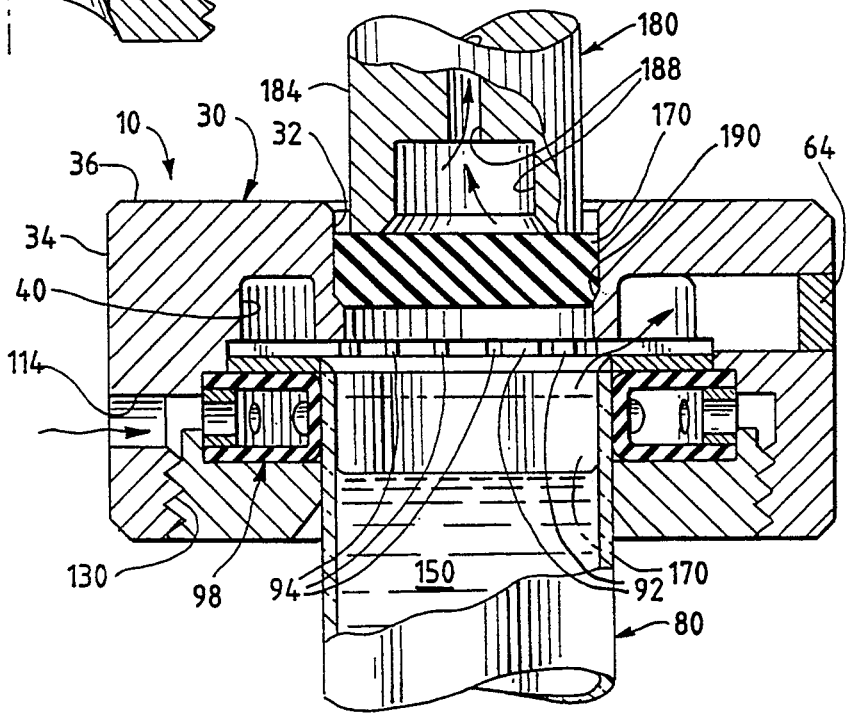

HEAD FOR APPARATUS FOR FILLING A CONTAINER AND PLACING A STOPPER THEREIN

TECHNICAL FIELD

This invention relates to a system for inserting a stopper into a container, such as a glass vial.

BACKGROUND OF THE INVENTION

Systems are in use for automatically filling a glass vial with a liquid product and then inserting a resilient, rubber stopper into the open end of the vial. One such system is employed by Abbott Laboratories, Inc., One Abbott Park Road, Abbott Park, Ill. 60064-3500 U.S.A. The system is incorporated in a production line for automatically filling glass vials with a liquid medicament. The production line includes a machine which fills each vial, inserts a stopper in the vial, and secures an overcap on the top of the vial over the stopper. This machine is designated as the "Abboject Vial Filling, Stoppering, And Capping Machine."

The Abboject Vial Filling, Stoppering, And Capping Machine includes a hollow, cylindrical head for receiving the upper, open end of the filled glass vial. Within the head there is an expandable, annular bladder which is inflated to seal around the exterior side surface of the vial just below the top opening of the vial. An arm, holding a stopper at the distal end by means of a conventional vacuum grip, inserts the stopper into the head above the filled vial open end.

A partial vacuum is then drawn within the head below the stopper through passages in the head. This exhausts a substantial portion of the air from the vial above the liquid level and permits the stopper to be forced into the vial so that the bottom of the stopper contacts, or is spaced just slightly above, the liquid in the vial. The stopper can be forced into the vial as the result of the pressure differential existing between the exhausted region below the stopper and the ambient atmosphere. In addition, or alternatively, the stopper can be forced downwardly by the arm.

In any event, proper sealing of the vial with the stopper requires removal of substantially all of the air from above the liquid in the vial. The air is exhausted through peripheral apertures in the cylindrical head which communicate with an annular chamber within the head. A radial bore establishes communication between the annular chamber and the exterior, cylindrical, side surface of the head.

The head is mounted in a vacuum manifold. The vacuum manifold defines a passage communicating with the radial vacuum bore in the head. The vacuum manifold passage has a counterbore for receiving an O-ring which is engaged by the exterior, cylindrical, side surface of the head when the head is properly mounted within the vacuum manifold. The vacuum manifold is connected to a suitable vacuum system for drawing vacuum in the manifold, head, and vial.

Although the above-described system functions generally satisfactorily, it has been found that problems can arise during operation of the production line. In particular, care must be taken to effect a good seal with the O-ring at the vacuum manifold in which the head is mounted.

Typically, different heads are required for different size vials. Accordingly, production workers must change heads when different size vials are to be filled. It has been found that it is difficult to achieve a good seal between the head and the vacuum manifold. When a good seal is not formed, leakage occurs at the O-ring. This results in leakage of ambient atmosphere into the system and a concomitant reduction in the level of vacuum drawing within the vial.

Accordingly, it would be desirable to provide an improved head in which the potential for leakage at the vacuum port is substantially reduced or eliminated.

It would also be beneficial if such an improved head could be embodied in designs that minimize or substantially eliminate structures that easily accumulate liquid or particulate matter and that are difficult to clean. Preferably, such an improved head should have a design that is consistent with aseptic production processes.

Finally, an improved head should accommodate rapid installation and removal by ordinary production workers and should embody a design that minimizes, if not eliminates, the likelihood of incorrect installation.

The present invention provides an improved head which can accommodate designs having the abovediscussed benefits and features.

SUMMARY OF THE INVENTION

An improved head is provided for receiving a filled container in an apparatus which places a stopper in the opening. The improved head permits vacuum to be drawn above the liquid in the vial so that in-leakage is substantially reduced or eliminated. The improved head can be provided with a design that minimizes liquid and particulate matter accumulation and that is relatively easy to clean. The improved apparatus can be relatively quickly installed in, or removed from, a vacuum manifold mount.

The head includes a sleeve, which may include an inflatable bladder, for receiving the end of a container and temporarily sealing the periphery of the container around the opening.

A housing is provided over the sleeve, and the housing defines an access passage to afford communication with the interior of the sleeve. The access passage accommodates the filling of the container and insertion of the stopper.

The housing defines a chamber around the access passage for communicating with the access passage. A conduit projects from the housing and is in communication with the chamber. Vacuum can be drawn through the conduit to remove air from the vial as the stopper is inserted.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

FIG. 5 is an exploded, perspective view of the head partially in cross-section.

FIG. 6 is a cross-sectional view of the head assembly during the stopper inserting operation.

DESCRIPTION OF THE PREFERRED EMBODIMENT

While this invention is susceptible of embodiment in many different forms, this specification and the accompanying drawings disclose only one specific form as an example of the invention. The invention is not intended to be limited to the embodiment so described, however. The scope of the invention is pointed out in the appended claims.

For ease of description, the head of this invention is described in the normal (upright) operating position, and terms such as upper, lower, horizontal, etc., are used with reference to this position.

Some of the figures illustrating an embodiment of the head and related apparatus show structural details and mechanical elements that will be recognized by one skilled in the art. However, the detailed descriptions of such elements are not necessary to an understanding of the invention, and accordingly, are not herein presented.

Figure 1:
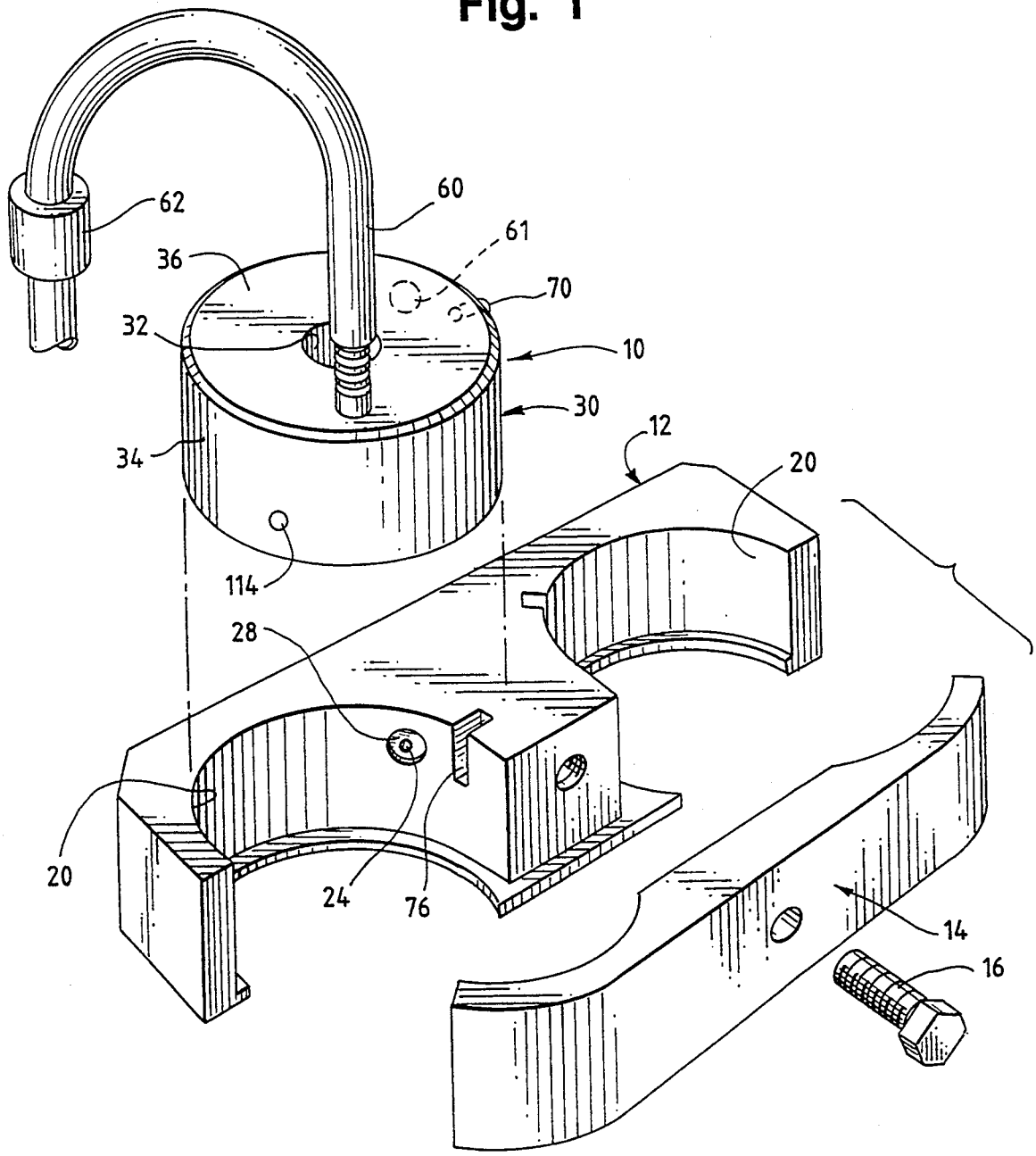
FIG. 1 is a simplified, partially diagrammatic, exploded, perspective view of the improved head of the present invention.

An improved head according to the present invention is designated generally by reference numeral 10 in FIG. 1. The head 10 is adapted to be mounted within a vacuum manifold 12 and retained thereon by a retainer bracket 14 secured with a bolt 16.

For ease of illustration, only one head 10 is shown, but the manifold 12 defines two recesses 20 for each receiving one of two such heads 10. The manifold 12 has a conventional design as used in the abovediscussed Abboject Vial Filling, Stoppering, and Capping Machine employed in production line processing of vials by Abbott Laboratories, Inc.

The manifold 12 defines a vacuum passage 24 which is open to the recess 20 where the passage 24 is surrounded by a counterbore 28. The passage 24 and counterbore 28 have been designed for use with a prior art head and are not functional with the improved head 10. In the prior art system an O-ring (not shown) is normally disposed within the counterbore 28.

The head 10 includes a housing 30 having a generally hollow, cylindrical configuration defining an access passage 32 and a generally cylindrical, exterior, side surface 34. The access passage 32 is a generally cylindrical opening extending completely through the center of the housing 30. The top of the housing is defined by a generally planar, annular surface 36.

Figure 2:
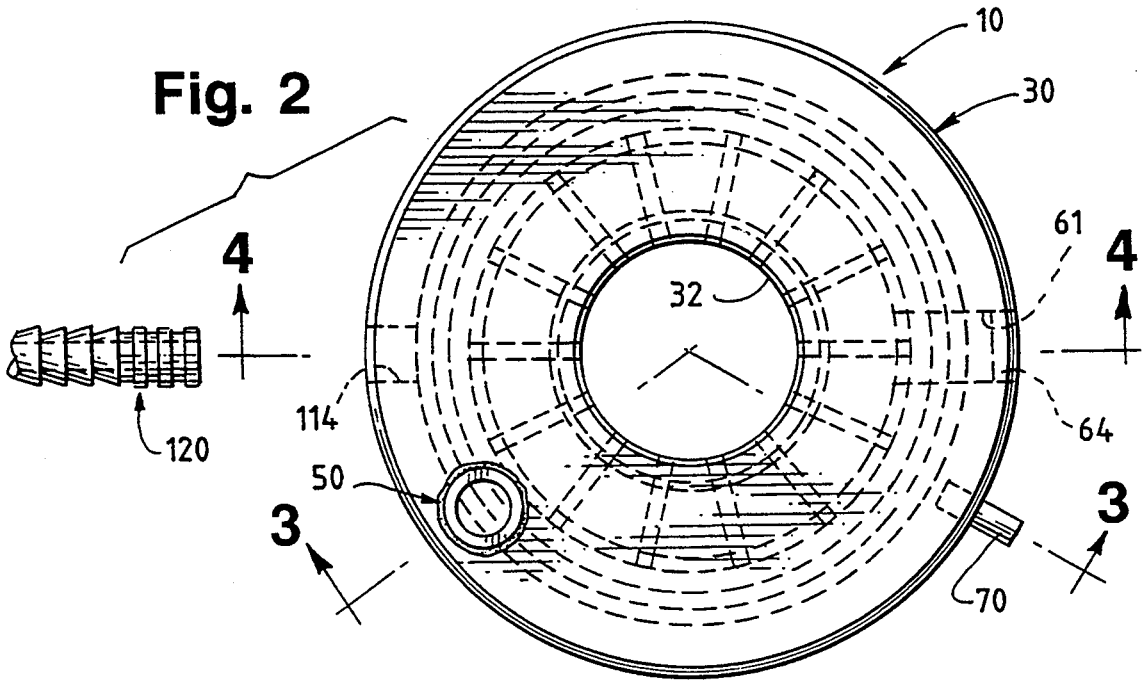
FIG. 2 is a top plan view of the head.
Figure 3:
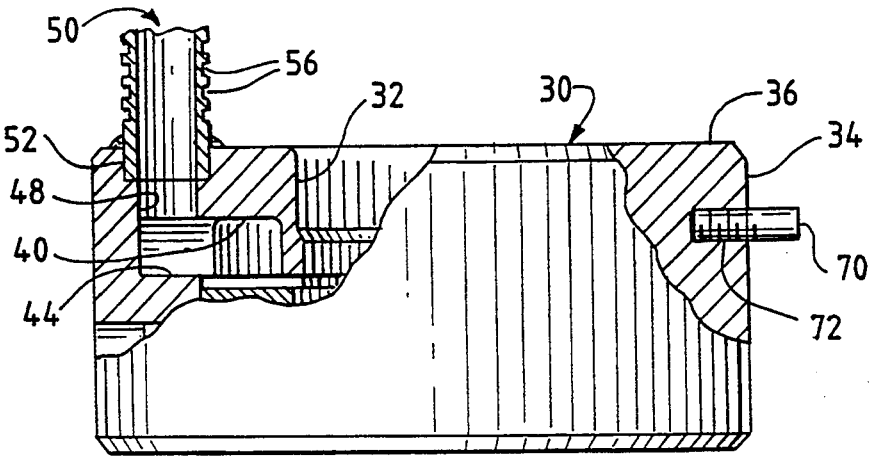
FIG. 3 is a partial cross-sectional view taken generally along the planes 3—3 in FIG. 2.

The housing 30 defines a generally annular, downwardly open chamber 40 which is concentric with the access passage 32. The chamber 40 is connected via a short, radial passage 44 to a axially oriented, vertical passage 48 which extends to the housing top surface 36 (FIG. 3). A conduit 50 (FIGS. 1, 2, and 3) is disposed within a counterbore in the housing 30 around the bore 48. The conduit 50 projects upwardly from the housing top surface 36 and is in communication with the bore 48.

In the preferred form illustrated, the conduit 50 is a generally cylindrical, metal tube which is welded, as at 52, to the top surface 36. An upper portion of the conduit 50 includes a plurality of spaced-apart, parallel, annular grooves 56 (FIG. 3). The groove structure can be engaged by a resilient hose 60 (FIG. 1) inserted over the conduit open end. This provides a tight connection which can be disassembled when desired. The hose 60 is connected through an electrically actuated solenoid valve 62 to a reduced pressure (i.e., partial vacuum) source (not illustrated).

The vacuum hose 60 can be a conventional type for sealingly engaging the upper end of the conduit 50 and preventing any substantial in-leakage of ambient atmosphere. However, when it is desired to remove and replace the head 10, the vacuum hose 60 can be readily removed from the upper end of the conduit 50.

Figure 4:
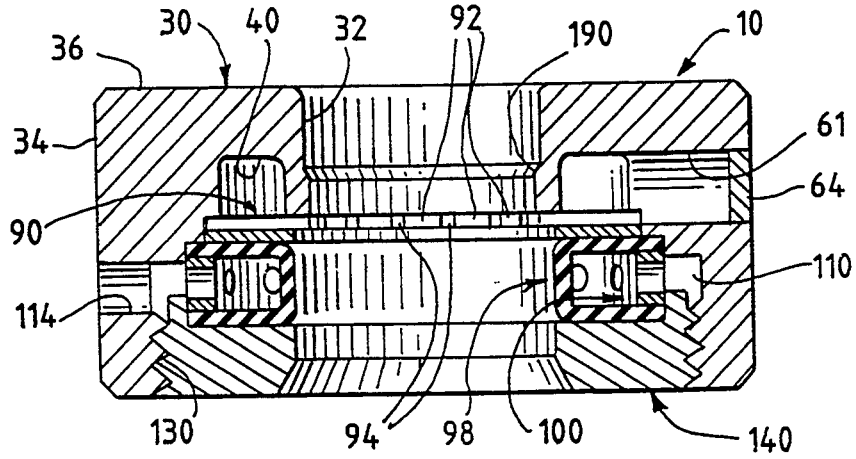
FIG. 4 is a cross-sectional view taken generally along the plane 4—4 in FIG. 2.

A prior art housing can be modified to form the improved housing 30. The prior art housing has a vacuum passage 61 (FIG. 4) which is not used in the new design. The passage 61 extends radially outwardly from the annular chamber 40 for communicating, in the prior art system, with the manifold passage 24 (FIG. 1). However, in the improved housing 30 the non-functional bore 61 is preferably occluded with a plug 64 (FIG. 4).

The housing 30 is also preferably provided with a locating pin 70 threadingly received in a suitable bore 72 so as to project outwardly from the cylindrical side surface 34 of the housing 30. The distal end of the pin 70 is adapted to be received in a vertically aligned groove 76 (FIG. 1) in the recess 20 of the manifold 12.

Because the prior art vacuum bore 61 is occluded with the plug 64 in the improved head 10 and because the vacuum is drawn instead through the conduit 50 and hose 60, the prior art vacuum connection to the manifold the vacuum passage 24 can be disconnected. Therefore, vacuum in the chamber 40 of the new head 10 can be drawn solely through the hose 60.

The head 10 includes a number of other components for properly receiving the upper, open end of a vial, such as a vial 80 illustrated in FIG. 6. These components include a polymer plastic vacuum plate 90 which includes segments 92 projecting radially inwardly so as to define a plurality of radially oriented slots 94. Below the plate 90 is an annular sealing sleeve or bladder 98 fabricated from resilient material. The bladder 98 has an annular channel configuration which opens radially outwardly to receive a spacer member 100. The spacer member 100 has an annular configuration and also has a circumferential array of radially oriented, circular apertures 104.

An annular space between the exterior circumference of the spacer member 100 and the inside surface of the housing 30 defines a pressure chamber 110. A bore 114 extends from the pressure chamber 110 to the exterior side surface 34 of the housing 30 for being connected to a pressurized gas conduit or fitting 120 (FIG. 2).

The bottom end of the housing 30 is threaded, as at 130, for threadingly receiving a retainer ring 140 which holds the bladder 98, spacer member 100, and vacuum plate 90 in position within the housing 30 as illustrated in FIG. 4.

The head 10 is adapted to receive the upper, open end of the glass vial 80 as illustrated in FIG. 6. The vial contains a liquid product which has been dispensed into the vial at a prior processing station. The upper edge of the glass vial 80 is initially seated against the downwardly facing surfaces of the inwardly projecting segments 92 of the vacuum plate 90. Next, pressurized gas is introduced into the bladder 98 via the pressure passage 114 and annular pressure chamber 110. This expands the bladder 98 to form a leak-tight peripheral seal around the exterior surface of the filled vial 80.

Next, a stopper tool 180 positions a resilient, rubber stopper 170 (FIG. 6) in the access passage 32. A conventional stopper tool 180 has a vertically oriented, cylindrical arm 184 defining a central vacuum passage 188. A reduced pressure (i.e., partial vacuum) is temporarily maintained within the passage 188 (by suitable, conventional means not illustrated) so as to hold the rubber stopper 170 on the end of the arm 184.

In the preferred embodiment illustrated, the housing 30 defines an angled shoulder 190 in the access passage 32 and defines a reduced diameter lower portion for initially receiving the bottom edge of the stopper 170. After the stopper 170 has been initially positioned as illustrated in solid lines in FIG. 6, the pressure in the stopper tool central passage 188 is returned to atmospheric pressure, and a reduced pressure is drawn in the vacuum chamber 40 via the vacuum hose 60 by opening the solenoid valve 62 to establish communication with the vacuum source. This causes a substantial reduction in pressure above the liquid 150 in the vial 80, and the rubber stopper 170 is pulled downwardly to substantially the level of the liquid 150 as illustrated in dashed line in FIG. 6.

After the vial 80 has been sealed with the rubber stopper 170, the bladder 98 is depressurized. The vial 80 can be subsequently removed from the head 10, and the stopper tool 180 can be retracted upwardly from the head 10. The head 10 is then ready to receive a new, empty vial.

During placement of the stopper 170 in the vial 80, the improved head 10 of the present invention operates to exhaust the vial atmosphere in a manner that substantially reduces or eliminates in-leakage. This results from the improved vacuum connection (e.g., the conduit 50 and related structures) which facilitates rapid installation and removal of the head 10.

The connection of the hose 60 to the conduit 50 is easily visible to an operator and is readily accessible. The head also has a configuration which minimizes the regions in which liquid and particulate matter can accumulate. Further, the improved head has a configuration which is easy to clean and facilitates use in aseptic processing.

It will be readily apparent from the foregoing detailed description of the invention and from the illustrations thereof that numerous variations and modifications may be effected without departing from the true spirit and scope of the novel concepts or principles of this invention.

What is claimed is:

1. An improved head for an apparatus which places a stopper in the opening of a filled container, said head comprising:

a sleeve for receiving the end of said container and temporarily sealing the periphery of said container around said opening;

a housing over said sleeve, said housing defining an access passage which communicates with said sleeve and through which said stopper can be inserted, said housing defining a chamber around said access passage for communicating with the access passage and wherein said housing has a generally hollow, cylindrical configuration defining a generally cylindrical, exterior side surface; and a conduit projecting from said housing in communication with said chamber through which vacuum can be drawn and wherein said conduit is a hollow, cylindrical tube mounted to said housing radially inward of said housing side surface.

2. The head in accordance with claim 1 in which said sleeve is a resilient bladder which has a generally annular configuration and which can be expanded by inflation with a pressurized gas.

3. The head in accordance with claim 1 in which said conduit is a metal tube having an upper, open end for being engaged by a resilient hose which can be inserted over said tube open end and which can be connected to a source of reduced pressure on said apparatus.

4. The head in accordance with claim 1 in which said chamber includes an annular cavity around said access passage and at least one passage extending from said annular cavity to the top of said housing.

5. An improved head for an apparatus which places a stopper in the opening of a filled container, said head comprising:

a housing having a top surface and defining an access passage extending from said top surface through said housing, said housing further including a chamber around said access passage for communicating with the access passage and wherein the top surface is a generally planar surface having an annular configuration defining an end of said access passage;

a sleeve adjacent said housing defining an aperture aligned with said access passage for receiving the end of said container and temporarily sealing the periphery of said container around said opening below said access passage to accommodate insertion of said stopper through said access passage; and a conduit projecting from said top surface in communication with said chamber through which vacuum can be drawn, wherein said conduit is a generally cylindrical tube welded to said top surface in an orientation generally perpendicular to said top surface.

6. The head in accordance with claim 5 in which said conduit is a metal tube having an upper, open end and having a plurality of spaced-apart, parallel, annular grooves defined in the exterior of said tube for being engaged by a resilient hose which can be inserted over said tube open end and which can be connected to a source of reduced pressure on said apparatus.

7. The head in accordance with claim 5 in which said housing has a generally hollow, cylindrical configuration defining a generally cylindrical, exterior, side surface; and said conduit is a hollow, cylindrical tube mounted to said housing radially inwardly of said housing side surface.

8. The head in accordance with claim 5 in which said sleeve is a resilient bladder which has a generally annular configuration and which can be expanded by inflation with a pressurized gas.

9. The head in accordance with claim 5 in which said chamber includes an annular cavity around said access passage and at least one passage extending from said annular cavity to the top of said housing.

* * * * *